US007918325B2

(12) United States Patent
Cozzuto

(10) Patent No.: US 7,918,325 B2
(45) Date of Patent: Apr. 5, 2011

(54) MOVING STAIRCASE WITH A DOUBLE STEP FLIGHT

(76) Inventor: Luigi Cozzuto, Formia (IT)

( * ) Notice: Subject to any disclaimer, the term of this patent is extended or adjusted under 35 U.S.C. 154(b) by 0 days.

(21) Appl. No.: 12/811,697

(22) PCT Filed: Sep. 26, 2008

(86) PCT No.: PCT/IB2008/053930

§ 371 (c)(1),
(2), (4) Date: Jul. 2, 2010

(87) PCT Pub. No.: WO2009/093103

PCT Pub. Date: Jul. 30, 2009

(65) Prior Publication Data

US 2010/0282569 A1 Nov. 11, 2010

(30) Foreign Application Priority Data

Jan. 23, 2008 (IT) ..... NA2008A0005

(51) Int. Cl.
*B66B 21/02* (2006.01)

(52) U.S. Cl. ..... 198/326; 198/323

(58) Field of Classification Search ..... 198/326, 198/323, 322, 321

See application file for complete search history.

(56) References Cited

U.S. PATENT DOCUMENTS

| | | | | |
|---|---|---|---|---|
| 25,706 | A * | 8/1859 | Ames | 198/326 |
| 2,664,990 | A | 1/1954 | Georgiev et al. | |
| 2,794,531 | A | 6/1957 | Stelzer | |
| 3,913,723 | A | 10/1975 | Johnson | |
| 4,438,830 | A * | 3/1984 | Born | 198/323 |
| 5,107,975 | A | 4/1992 | Iwata | |
| 5,193,650 | A * | 3/1993 | Kent, Jr. | 198/322 |
| 6,342,768 | B1 * | 1/2002 | van der Heiden | 198/321 |
| 6,435,308 | B2 * | 8/2002 | Grass | 198/321 |
| 6,527,098 | B2 * | 3/2003 | Krampl | 198/326 |
| 7,131,522 | B2 * | 11/2006 | Sircovich | 198/322 |

FOREIGN PATENT DOCUMENTS

| | | |
|---|---|---|
| GB | 11482 | 7/1902 |
| GB | 781245 | 8/1957 |
| WO | WO/2007/107086 | 9/2007 |
| WO | WO/2007/137499 | 12/2007 |

OTHER PUBLICATIONS

International Search Report for PCT/IB2008/053930 filed on Sep. 26, 2008 in the name of Luigi Cozzuto.
Written Opinion for PCT/IB2008/053930 filed on Sep. 26, 2008 in the name of Luigi Cozzuto.
International Preliminary Report on Patentability on PCT/IB2008/053930 filed on Sep. 26, 2008 in the name of Luigi Cozzuto.

* cited by examiner

*Primary Examiner* — James R Bidwell
(74) *Attorney, Agent, or Firm* — Steinfl & Bruno LLP

(57) ABSTRACT

A moving staircase (escalator) with two flights of steps (1, 1'), a first flight for resetting one foot and a second flight for resting the other foot, equipped with synchronized reciprocating motion so that when the first flight goes up the second one goes down by the pace corresponding to a step, the user, by alternating the resting foot onto the steps of the two flights, will make no effort in waiting along it and he/she will not have to bend the limbs. The elevator finds its elective application as emergency escalator, also as fire-fighting staircase and as moving staircase for users prevented from an ease moving of limbs. The escalator can also-conveniently be rested onto pre-exiting flights.

16 Claims, 17 Drawing Sheets

MOVING STAIRCASE WITH A DOUBLE STEP FLIGHT

CROSS REFERENCE TO RELATED APPLICATIONS

The present application is the US national stage of International Application PCT/IB2008/053930 filed on Sep. 26, 2008 which, in turn, claims priority to Italian Application NA2008A000005, filed on Jan. 23, 2008.

FIELD OF THE INVENTION

The present invention relates to a moving staircase (escalator) with two flights of steps, a first flight for resting one foot and a second flight for resting the other foot, equipped with synchronized reciprocating motion so that when the first flight goes up the second one goes down by the pace corresponding to a step; the user, by alternating the resting foot onto the steps of the two flights, will make no effort in walking along it and he/she will not have to bend the limbs. The escalator finds its elective application as emergency escalator, also as fire-fighting staircase and as moving staircase for users prevented from an ease moving of limbs. The escalator can conveniently be also rested onto pre-existing flights.

PRIOR ART

The patent UK 781,245 describes an escalator with mechanical elevation with the shifting of a continuous step for resting both feet. The escalator leads to a reduction in the user ascending steps, but it forces the user to be able to bend the limbs.

The patent applications WO2007/107086 and WO2007/137499 relate to a system of interdependent bi-directional side-by-side escalators with single motorization and a system for inverting the motion of the transmission axes by means of interposed gearing. The escalators have a reduced energy consumption under the condition of usual passage flow in the two directions (the descending load onto a balancing, the ascending one onto the other one, for ex. interchange points between underground railways).

TECHNICAL PROBLEM

The invention escalator proposes to solve all those cases wherein the user has to go up or down and is not able to perform a correct limb bending and/or when it is not possible or convenient implementing traditional escalators or elevators for overcoming the differences in height.

DESCRIPTION OF THE INVENTION

The escalator can be used both for going up and going down. It is equipped with two side-by-side and coplanar flights of steps and with means so as to perform a synchronized reciprocating motion of the pace corresponding to one step. The user must simply move laterally the resting foot onto the steps which appear waiting for at the same level in order to make the escalator to raise it or to let it to go down. The simple translation of the user's feet allows using the escalator also by whoever is not able to bend the limbs. The activation of the escalator mobility is voluntary, namely it is controlled by the user, even at each pace.

The escalator can be installed in scaffoldings or it can be applied on pre-existing steps and it can also integrate the buildings' fire-fighting staircase in order to ease the evacuation thereof when, in case of emergency, the use of elevators is not allowed.

The escalator allows the easy contemporary shifting between the users' planes in both moving directions. The escalator can be low-tension supplied, with safety locking systems, and it can be installed also in outer environment.

Therefore, the object of the present invention is an escalator characterized by:

a) a first and a second flight, said flights being side by side and parallel, each one constituted by a same number of equidistant steps, b) motion means, so that the flights have a synchronized reciprocating motion of the pace corresponding to a step, wherein such means can be operated by the user of the same escalator;

c) safety means for locking the motion.

In a preferred embodiment the two flights are equipped with sensors for the applied loads. Preferably the steps of the two flights are of folding-type and equipped with safety motion switches.

Preferably the escalator is equipped with two safety-sensitive platforms, a lower one and an upper one.

In a preferred embodiment the escalator comprises a handrail equipped with a control device which can be manually activated by the user.

In a preferred embodiment the escalator motion means is mainly constituted by an engine block equipped with two mirror worm self-braking geared motors with opposite axes transmitting, with suitable means, the reciprocating synchronized motion of a step's pace to the flights.

The invention escalator will be now described in the preferred embodiments thereof by referring to the following figures, to be meant as explaining, but not limiting the protection scope:

FIG. 1 is a perspective front view of the escalator.

FIG. 2 1 is a perspective rear view of the escalator.

Figure 1:
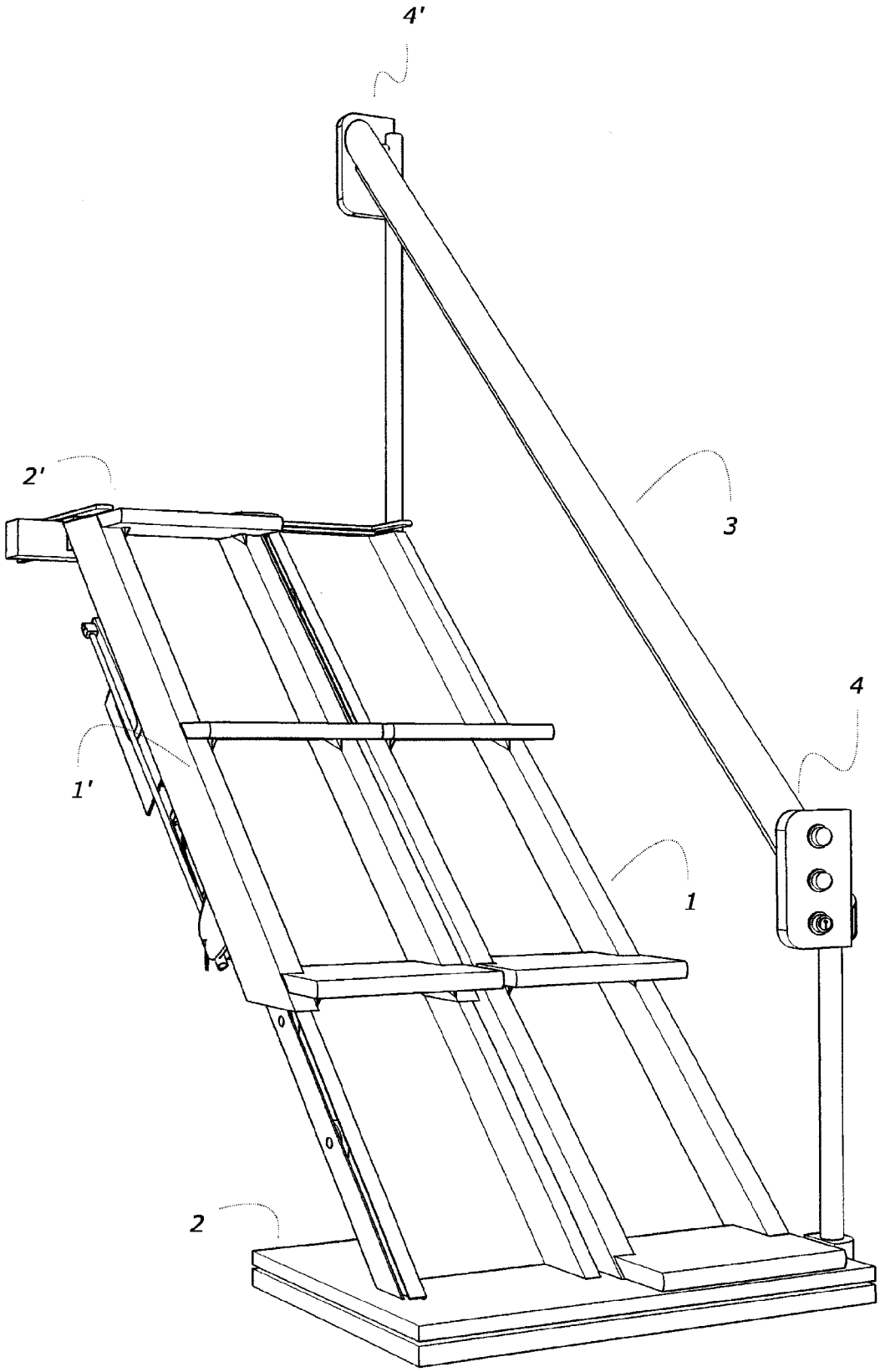
FIGS. 1 and 2 represent the overall view of the escalator, respectively providing a front and rear view. What is represented is an embodiment of the escalator according to the teaching of the invention which can be varied, such as for example, a length development greater than the illustrated one with the interposition of a greater number of steps.
Figure 2:
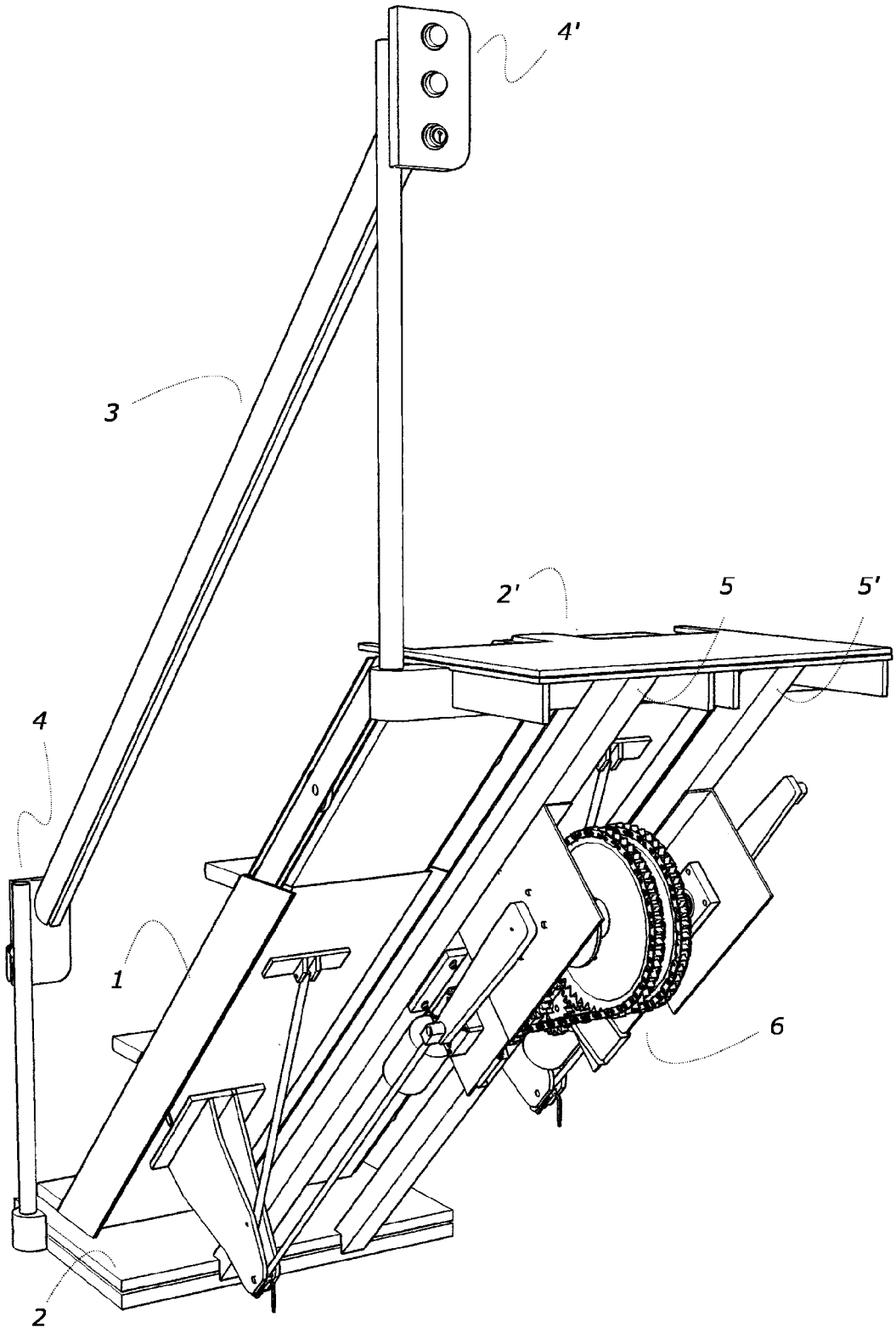

In FIG. 1 the two side by side flights (1-1') with related steps, two sensitive platforms, a lower one (2) and an upper one (2') and the handrail (3) activating the motion, equipped at the ends with panels with control buttons (4-4'), are highlighted. In FIG. 2 two of the bearing structural members (5-5') and the mechanical means (6) determining the motion of the flights of steps can be seen.

Structure

Figure 3:
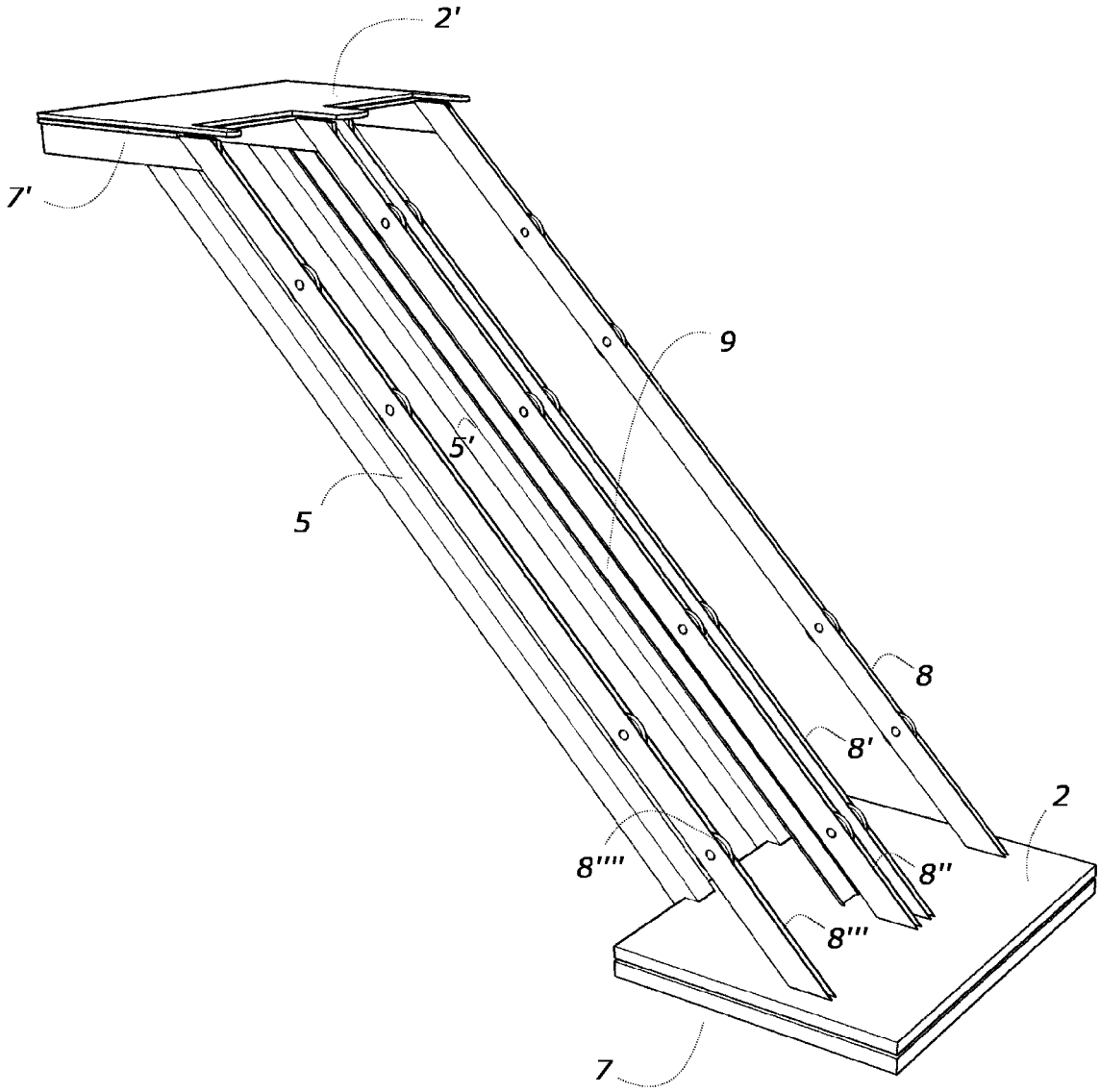
FIG. 3 is a perspective view of the bearing structure of the escalator wherein the slides for the flights and the sensitive platforms are highlighted.
Figure 4:
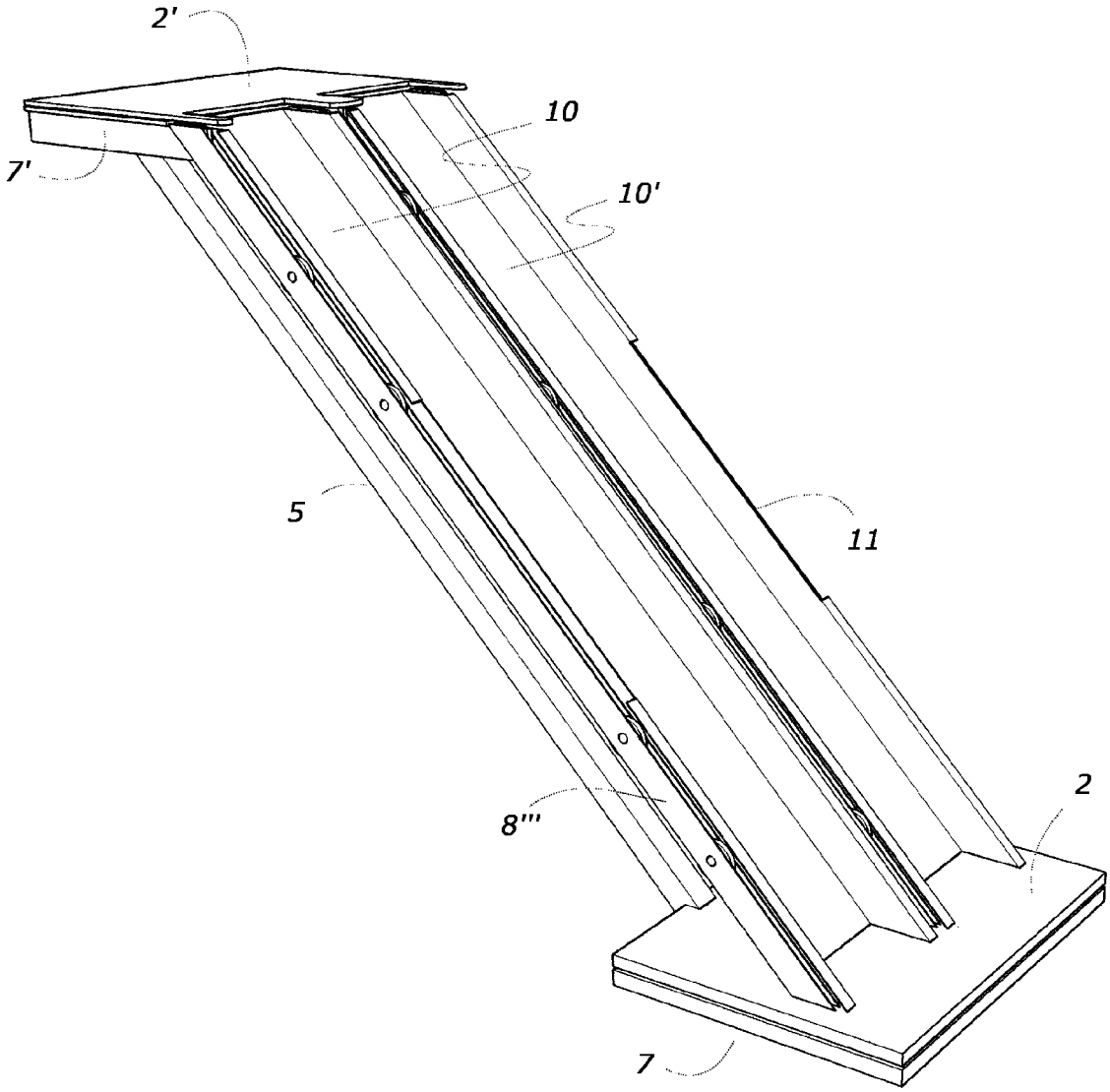
FIG. 4 is a view like the previous one added with protection panels.

The bearing structure of the escalator, represented in FIG. 3, is formed by two parallel side frames (5,-5') properly tilted onto the horizontal plane, connected to two supporting plates, a lower one (7), the upper other one (7'). The plates represent also the support for four parallel tracks (8, 8', 8", 8'") with inner wheels (8"") thereon the two flights rest and move with reciprocating motion. The sensitive platform 2 and 2' is applied onto each one of the plates 7 and 7', respectively; either the lower platform 2 and the upper one 2' are equipped with sensors so as to lock the already operating escalator if subjected to the trampling of another user; the upper one also in case there is interposition, between a going-up step and the platform, of possible objects or limbs. The structure is also equipped with another central bearing member with the function of eaves (9) and, as shown in FIG. 4, with two protection panels (10-10') anchored to the upper plate 7 and lower plate 7', the side edges thereof (11), properly shaped, insert into the air gaps of the flights and allow the passage, through the tracks, of the mobile electric connections of the trusses; on the lower side and laterally a sound-absorbent protection shielding (not represented), makes the motions means inaccessible.

Engine Block

Figure 5:
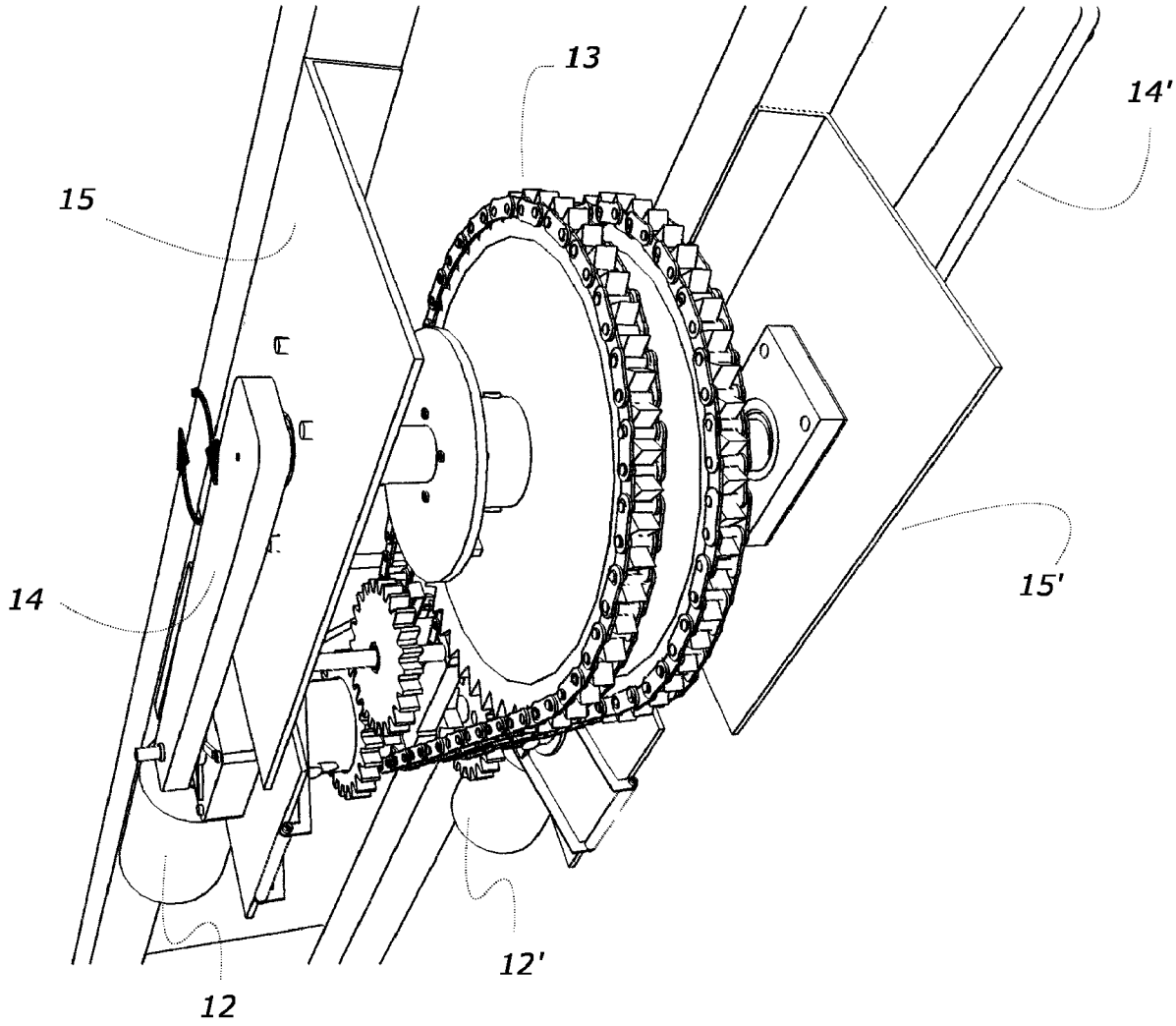
FIG. 5 is a view of the engine block with the members transmitting the motion to the steps.
Figure 6:
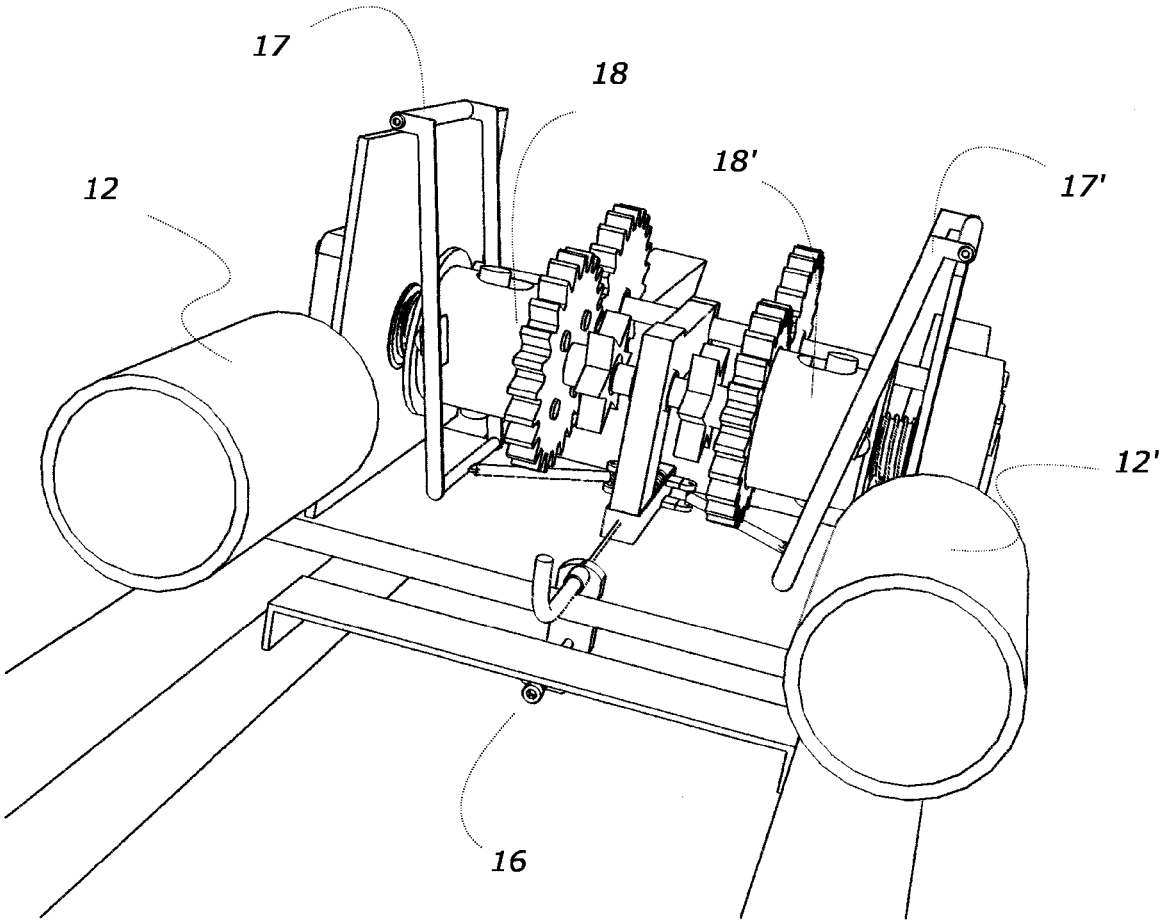
FIG. 6 is a view of the engine block with forks for releasing the pinions and system for regulating the chains' tension thanks to the sliding of the engine block onto side frames of the bearing structure.
Figure 7:
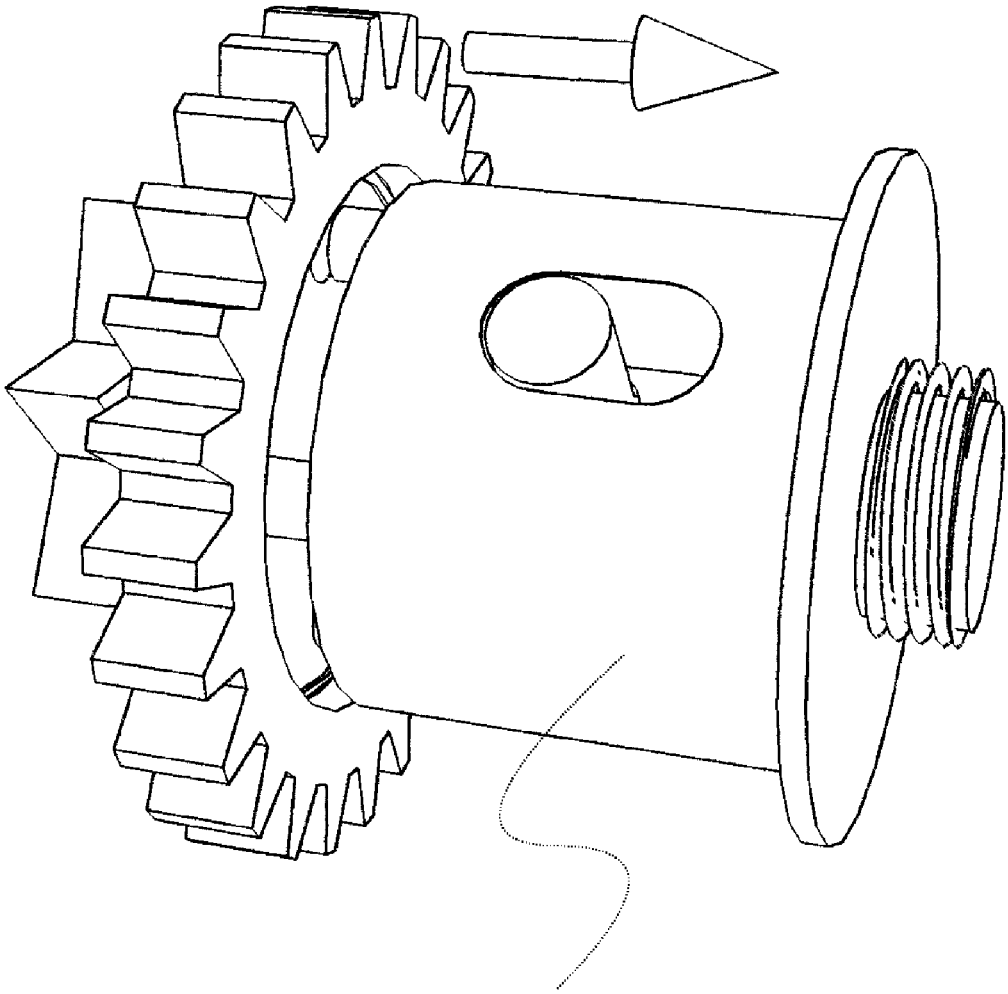
FIG. 7 is a view of the acting release joint with rear contrast spring.

The engine block constituted, as shown in FIG. 5, by two mirror worm self-braking geared motors with opposed axes (12-12') transmitting, by means of pinions, chains and gear rims (13), the motion to the flights (1,1') is applied in the portion underneath the side frames. The pinions are connected with double chains to two gear rings inserted onto a sleeve; two axes with torsion arms (14-14'), arranged at 180 degrees rotating at a constant and adjustable speed of about 10 rpm in the direction shown by the arrows in figure, project from the sleeve; the axes of the torsion arms (14,14') are housed in self-centering bearings with huge capacity with support and mounted onto the side frames by means of plates (15-15'). FIG. 6 shows that the chains are subjected to equal tension thanks to the adjustment of a central tightener of the engine block (16) which guarantees the alignment and the correct traction thereof, by reducing the yoke to the minimum. Such regulation is performed during the installation phase and/or in subsequent maintenances; for this operation or in case of the escalator disconnection, the pinions can be released from the traction of the geared motors by means of a remotely manually controlled double-fork device (17-17') acting at the same time onto two joints which can be translated onto their own axes (18-18'); the joint motion and detachment are represented in FIG. 7.

Flights

Figure 8:
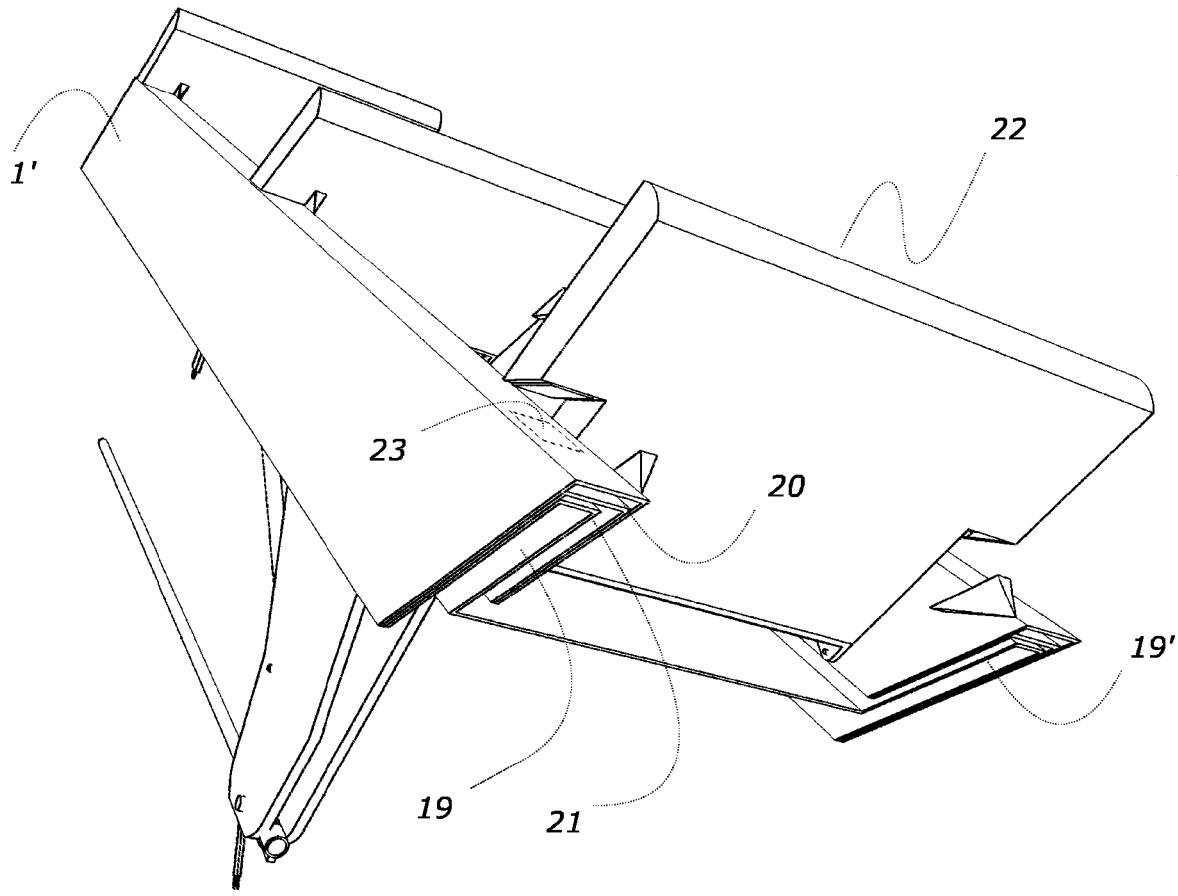
FIG. 8 is a bottom perspective view of the flight trusses in a single body with air gaps for housing the supporting slides, the protection panel and the circuit verifying the correct positioning of the steps.
Figure 9:
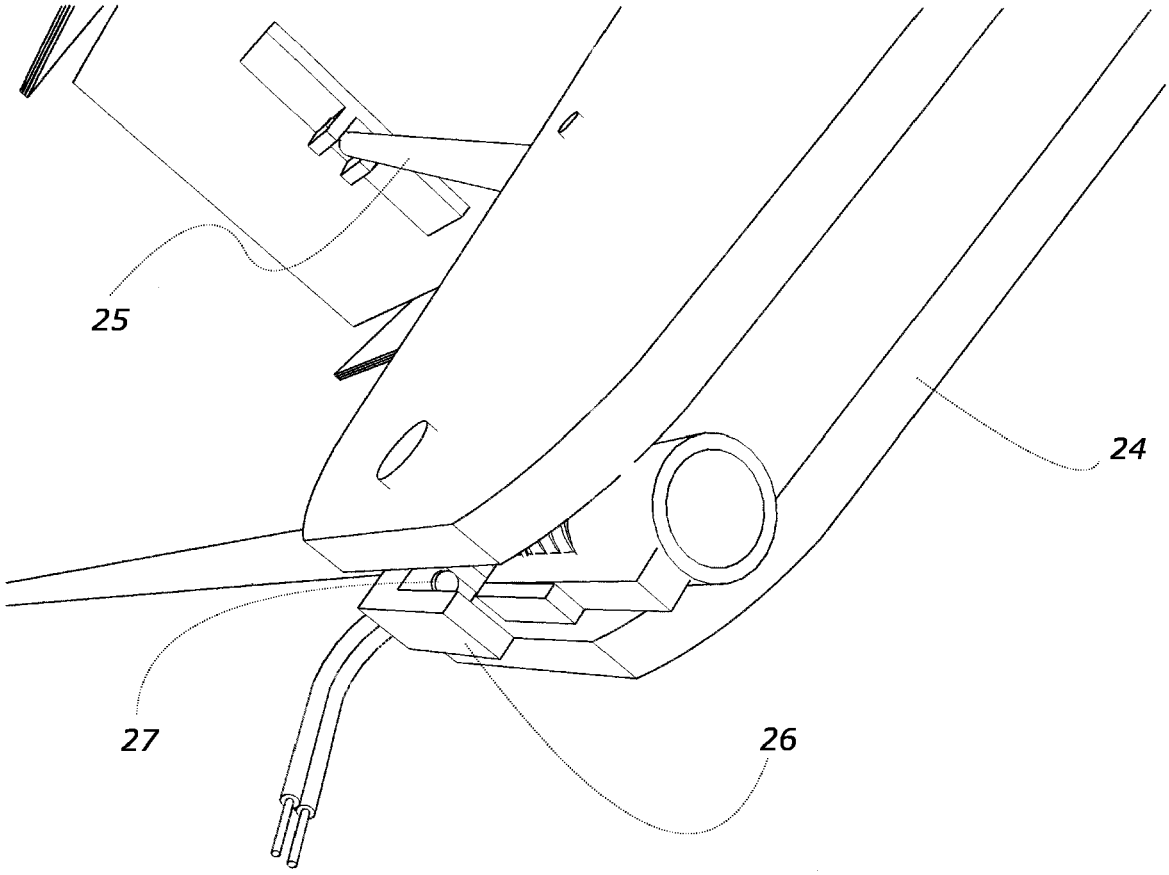
FIG. 9 is a perspective view of the support connecting the traction bar and the flight with sensor of the applied loads and compulsory support member.

The bearing structure of the two flights (1,1') (one thereof is illustrated in FIG. 8) is implemented with metal sheet with proper thickness which, belt on the sides with open rectangular profile, forms two deep guides (19-19') resting and sliding onto the tracks (8,8' for the first flight and 8", 8'" for the second flight 1') with structure rollers. Above each guide other two sheets with different length project which, applied laterally and folded inwardly with rectangular profile, create a truss with two air gaps; a closed one in the upper portion (20) the function thereof will be explained hereinafter, another one open with L-like shaped profile (21); this latter air gap is the sliding seat of the side edges of the protection panels of the flights connected to the plates of the bearing structure. The steps (22), equidistant therebetween for each flight, are applied onto the trusses. The step is pivoted in the inner portion of the trusses and rests, without being constrained, to specific supports onto the outer portion; this gives the step the possibility of rotating freely upwards in case of accidental interposition of foreign bodies. The flights are also the seat of control and safety circuits. In fact in the closed air gaps of the outer trusses of the two flights and for the entire length thereof, proximity magnetic switches (23) are housed and connected in series, placed at the contact point between each step and the truss. In the step, at the contact point, a permanent magnet is inserted allowing, when the step is horizontal, to close the N/O proximity switch placed in the underlying air gap allowing the operation. If a step rises due to the interposition of limbs or object, the switch opening causes the escalator motion to stop. The upper sheet of the outer trusses thereon the steps rest will have to be made with a material preventing the magnet from hanging up and thus being able to rise without resistance in order not to jeopardize the user safety. Below the steps, shown in FIG. 9, there are supports (24) with oblique members with anti-overturning function (25); the traction generated by the rotating motion of the torsion arms is applied onto the supports (24) and transmitted by stiff rods thereto they are connected. In the point connecting the support, the rod can freely slide inside a sleeve equipped with proximity (26) and limit (27) switches; the rod motion with respect to the sleeve, adequately opposed by a calibrated spring, for a higher load applied to the flights than the minimum calibration, carries the magnet at the N/O proximity switch (26) allowing the reciprocating motion of the flights; on the contrary, when the rod reaches the end of travel for applying the subsequent load, the opening of a N/C mechanical switch (27) is determined which, connected in series, stops the flights' motion.

Handrail

Figure 10:
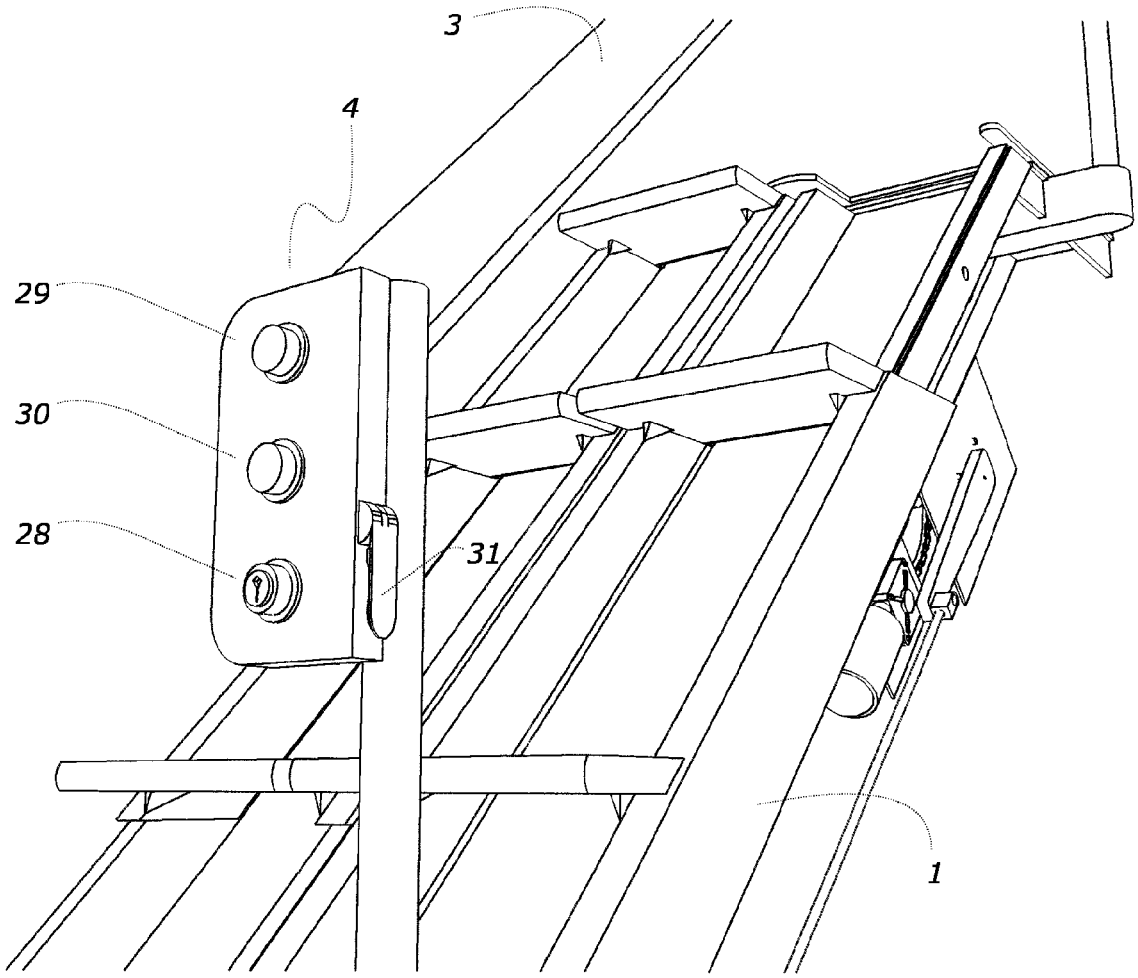
FIG. 10 is a view of the control panel at the lower end of the handrail with button panel and lever for the manual disconnection.
Figure 11:
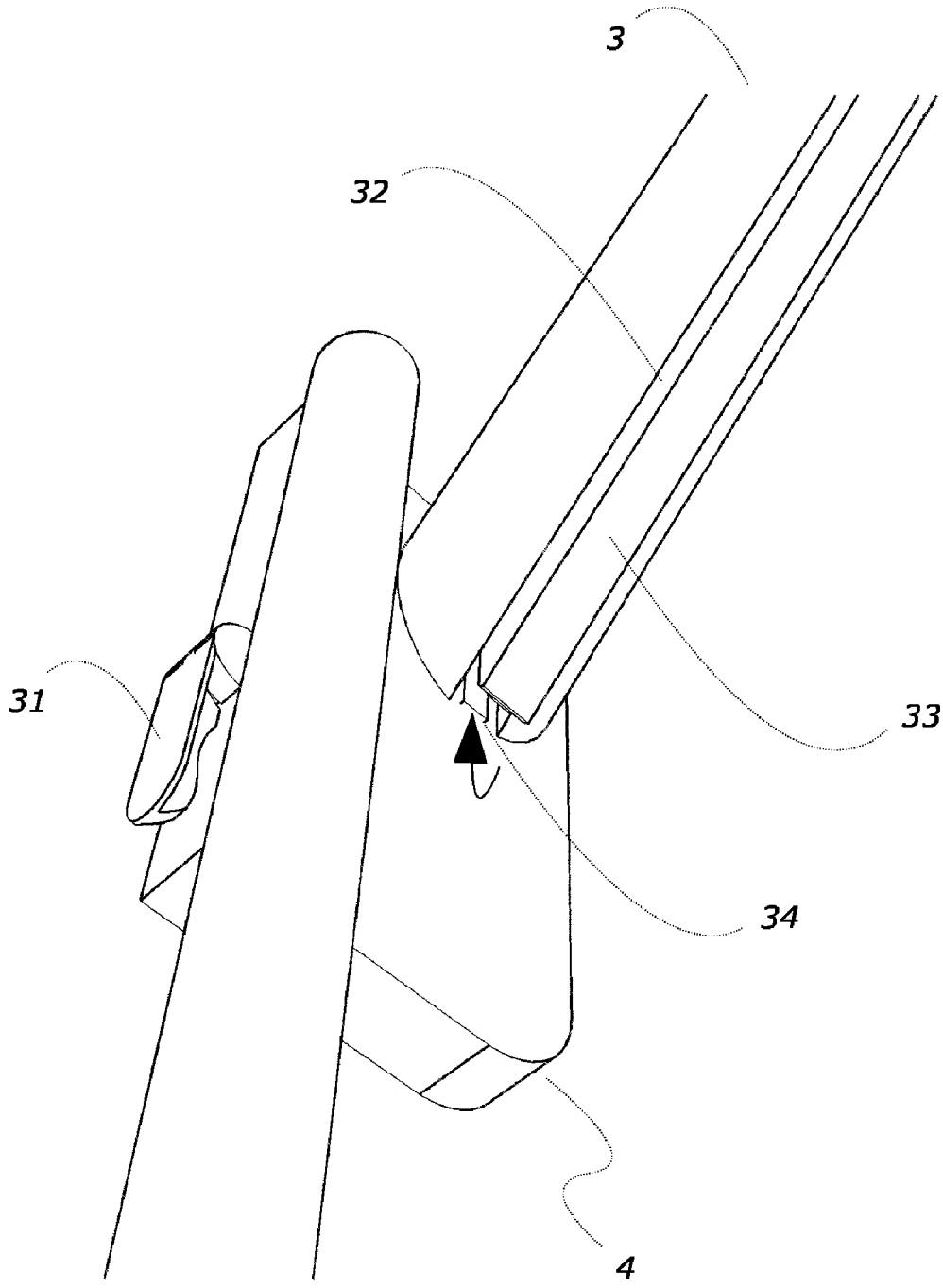
FIG. 11 is a view of the voluntary operation system integrated in the handrail.

As illustrated in FIG. 10, the handrail (3) is the seat therefrom the use implements the motion voluntary control. It has at the two ends the control panels (only one thereof is visible in FIG. 10) which are the seat of the activation on-off switch (28), of the emergency stop button (29) and of the return button (30); the latter, if activated, approaches the step to the starting platform. In fact, if the escalator is not used for a predefined time interval, a circuit activates automatically which is however subjected to all safety locking systems bringing the flights at ¼ of the whole stroke by implementing, with this stand-by arrangement, an escalator with reciprocating steps usable also as fixed escalator. Furthermore, onto the control panel at the basis of the handrail (4) there is a manual control device (31) which, by means of wire and sheath, acts onto the release system of the transmission joints, and at the same time interrupts the escalator power supply; it is used for the disconnection. Each emergency, linked to possible problems of malfunction is signaled, still onto the panels, by a both audio and visual alarm for the buttons' backlighting; the deactivation thereof is subjected to the direct intervention onto the manual control device (31). FIG. 11 illustrates the groove (32) going along the handrail for the whole length thereof; it receives a bar (33) the lifting thereof, with rotation and approaching to the upper portion of the control panel, activates a magnetic switch (34) determining the starting, or viceversa, in free position downwardly, the flight's reciprocating motion lock. When, during operation, the flights' stroke reaches the dead point, the motion stops automatically. In this waiting position the user has the possibility, with the stopped escalator, of shifting the foot resting onto the aligned step of the other flight and to rest the hand onto the handrail in a more advanced position with respect to the previous one; by winding with the hand grip the whole handrail circumference he/she rises again the switch-bar by starting the subsequent motion. If, during the stroke, for emergency, the user abandons the grip, the escalator stops.

Electric Circuit

Figure 12:
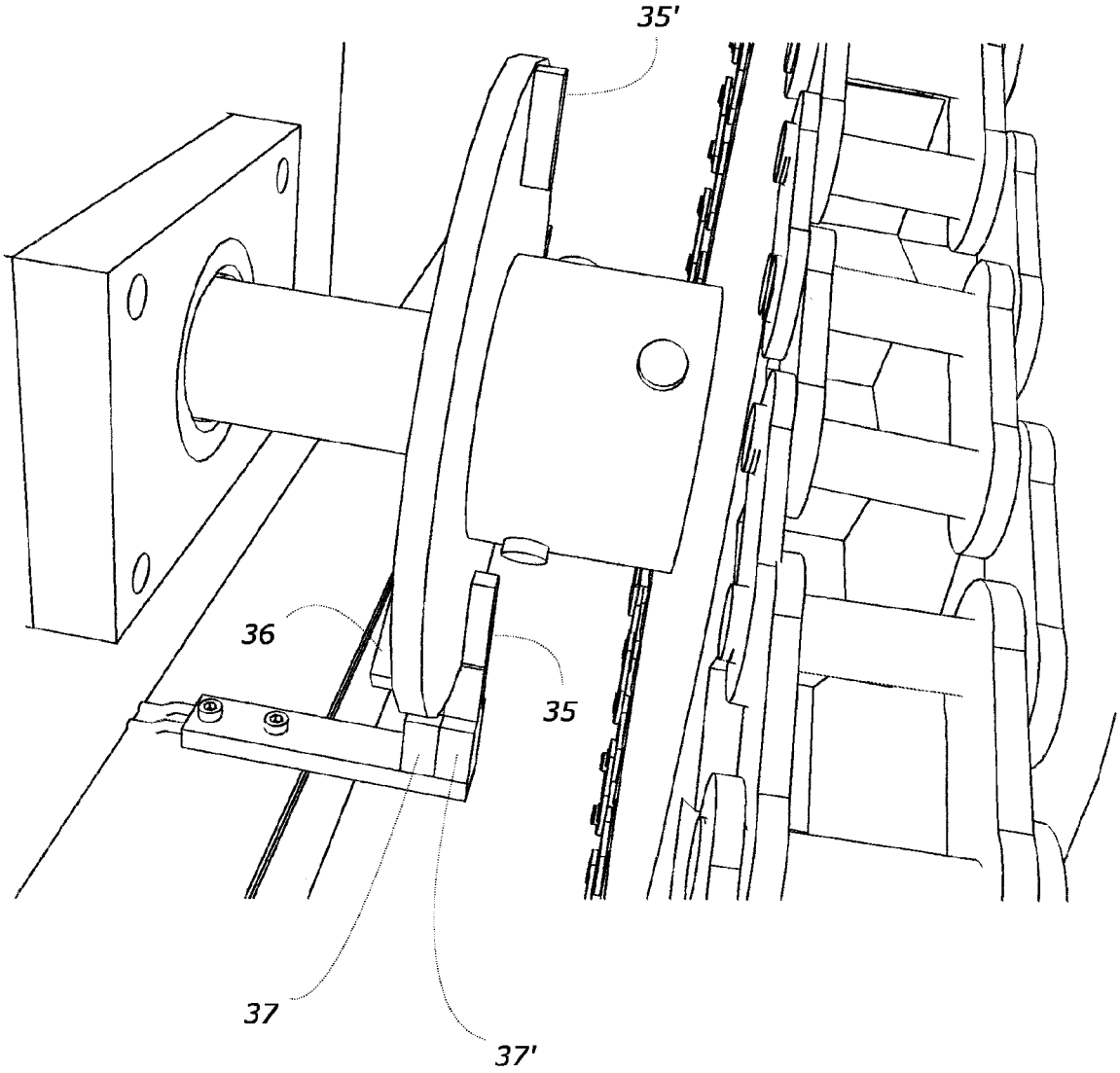
FIG. 12 is a view of the cyclic switch for allowing the escalator functions.

The device functions with low-tension direct current provided by a power battery, the recharge thereof takes place by means of a household network or, when it is not available, also with photovoltaic panels. Apart from the circuit controlling the motion by means of the handrail switch-bar, there is another safety one locking the motion when the sensitive platforms are stressed, if the steps are lifted, if an excessive load is applied onto the flights or if the emergency stop control device is activated. When the return button from the control panels is used approaching the outer steps of the flights to both platforms, the circuit will exclude automatically, as engaged by the user, the sensitive platforms from the locking function thereof. FIG. 12 illustrates a specific cyclic switch, integral to the sleeve, with magnets (35-35'-36) and proximity switches (37-37') controlling the various stop positions of the flights.

The power supply circuit of the engines provides two current limiting fuses controlling the contribution which each geared motor provides to the whole torsion torque by determining, in case of melting, the escalator lock; in fact, as the pinions of the geared motors rotate autonomously inserted onto a not integral central axis, an absorption beyond a prefixed limit can designate either the bad operation of one thereof or the rupture of the related transmission members. In each case the escalator, being no more under safety conditions, goes out of service and the audio and visual warning device of the control panels draws the operator intervention which will provide to put the escalator under safety conditions.

Deactivation

Figure 13:
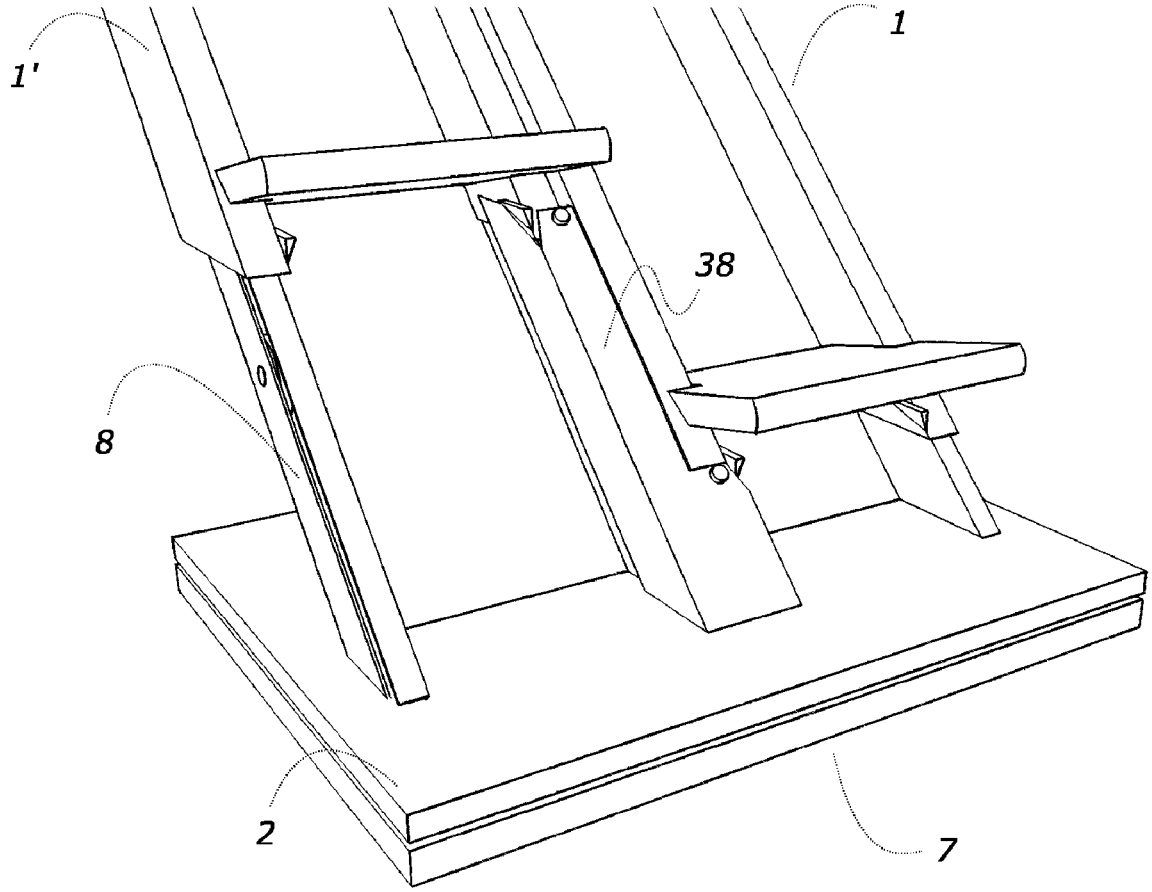
FIG. 13 is a view of the support and the application thereof for stopping the escalator.

There is also provided the possibility, as seen in FIG. 13, of locking the escalator, by means of suitable supporting plate (38), in fixed escalation position with reciprocating steps. Such operation provides the release if the traction system which can be implemented by operating onto the manual control device placed onto the control panel at the lower end of the handrail which, by spacing out the joints and releasing the pinions, allows the flights' manual motion for applying the supporting plate (38) at the flights' basis.

Other Solutions for Implementing the Traction System

In order to reduce the overall sizes of the engine block and of the traction underneath the escalator, or to ease the installation thereof onto pre-existing fixed escalators with low tilting, apart from traction systems implemented with pneumatic, hydraulic pistons or electro-mechanical actuators with synchronized reciprocating motion, herein an electro-mechanical solution is proposed, wholly grouped in the bearing structure. Like the previous one, it characterizes too for giving the flights a progressive acceleration upon the starting motion and, viceversa, a deceleration upon the arrival, by simulating the natural motion of a human pace.

Figure 14:
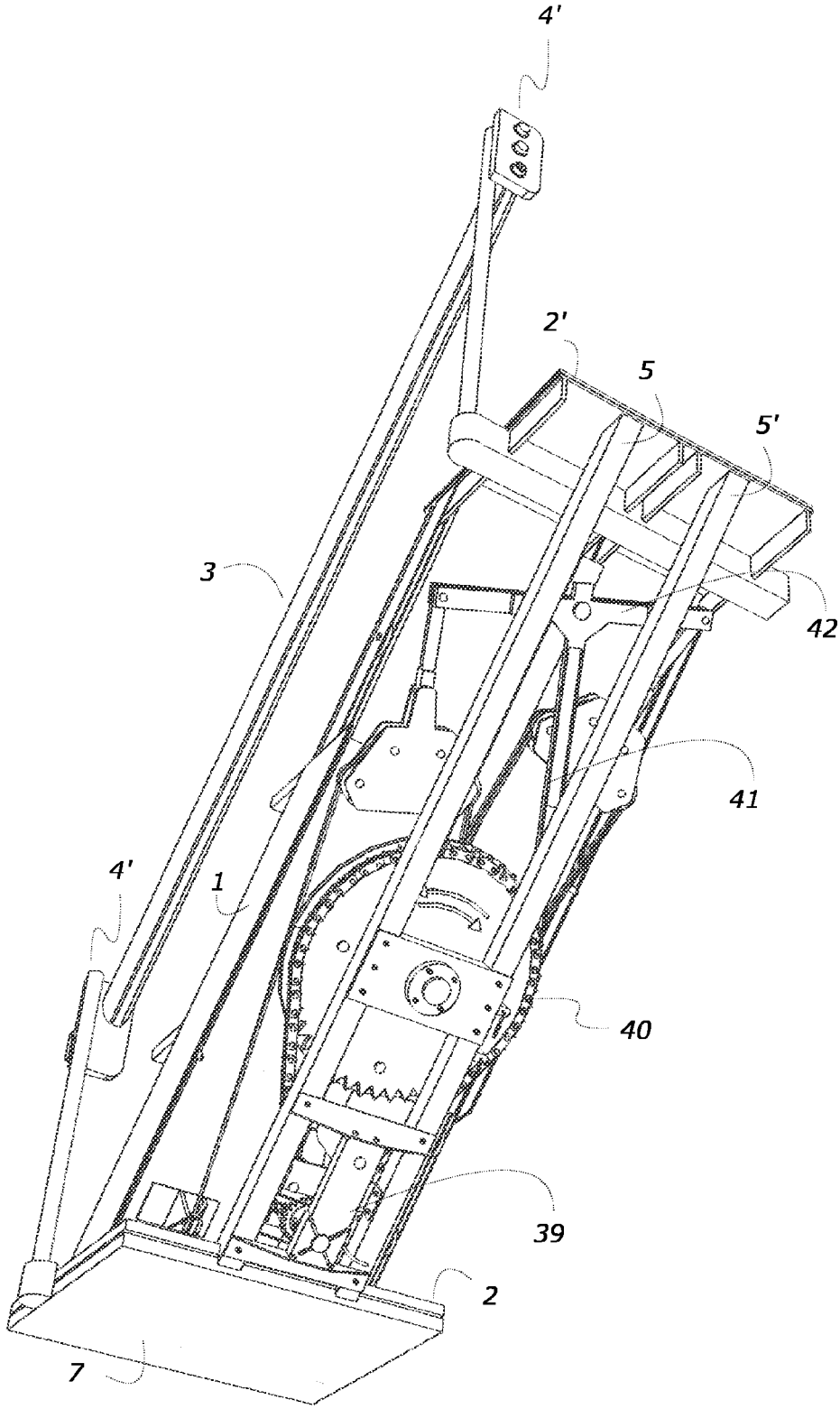
FIG. 14 is a rear perspective view of the escalator with traction mechanism integrated in the structure.
Figure 15:
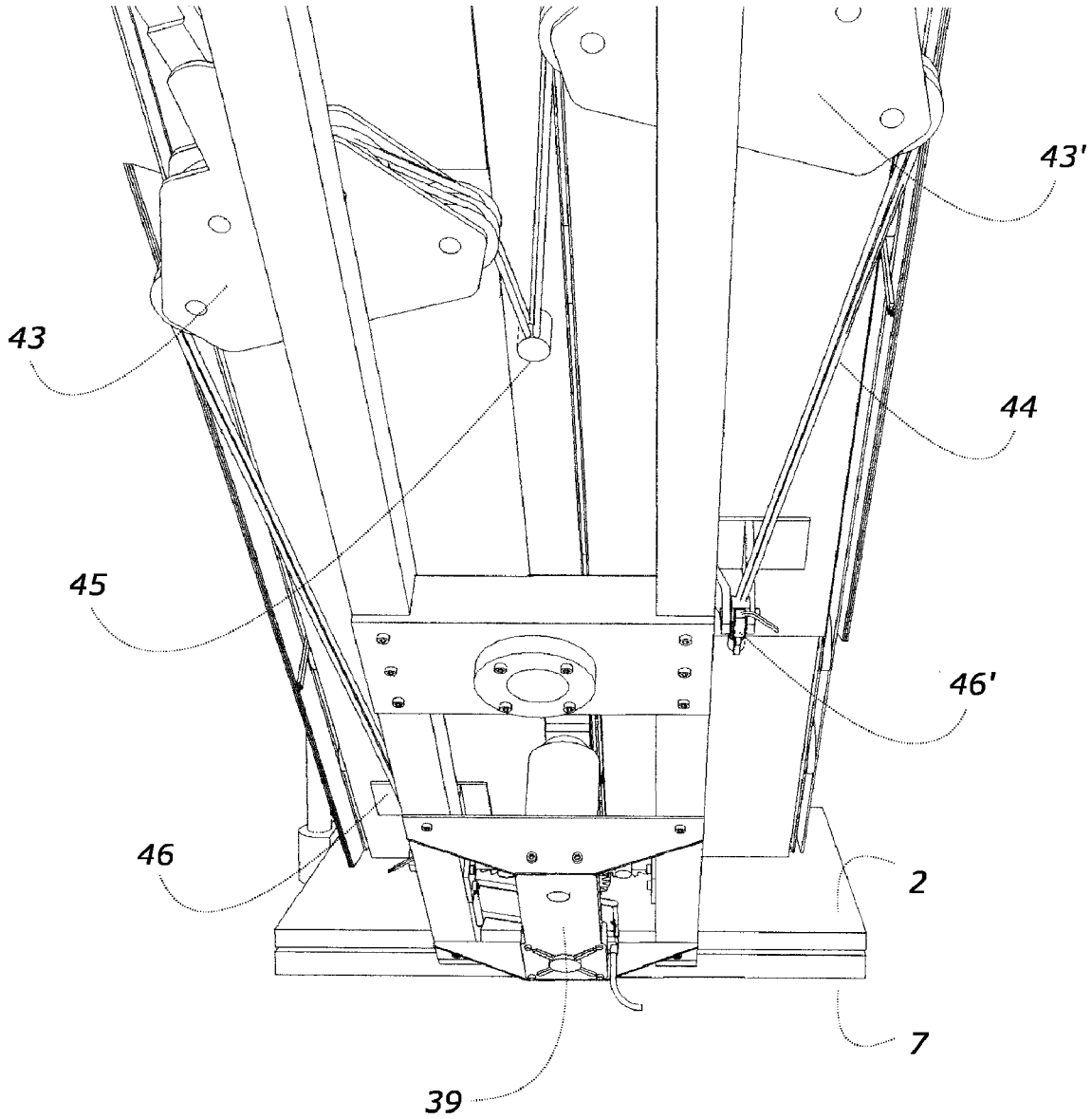
FIG. 15 is a view of the sites for applying the traction cables and pulleys.
Figure 16:
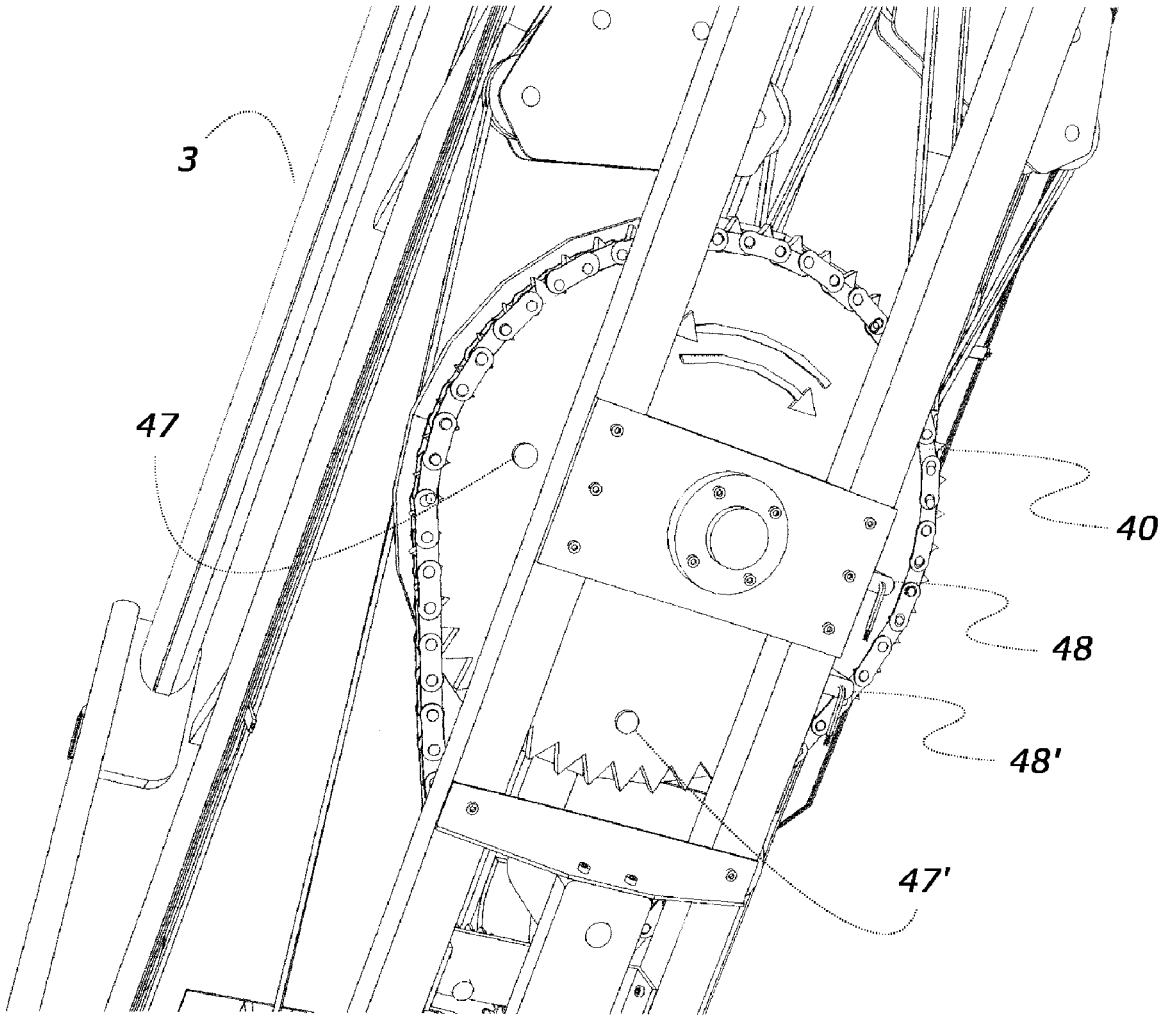
FIG. 16 is a view of the three magnets for activating the positioning switches, wherein one thereof engages the switch.
Figure 17:
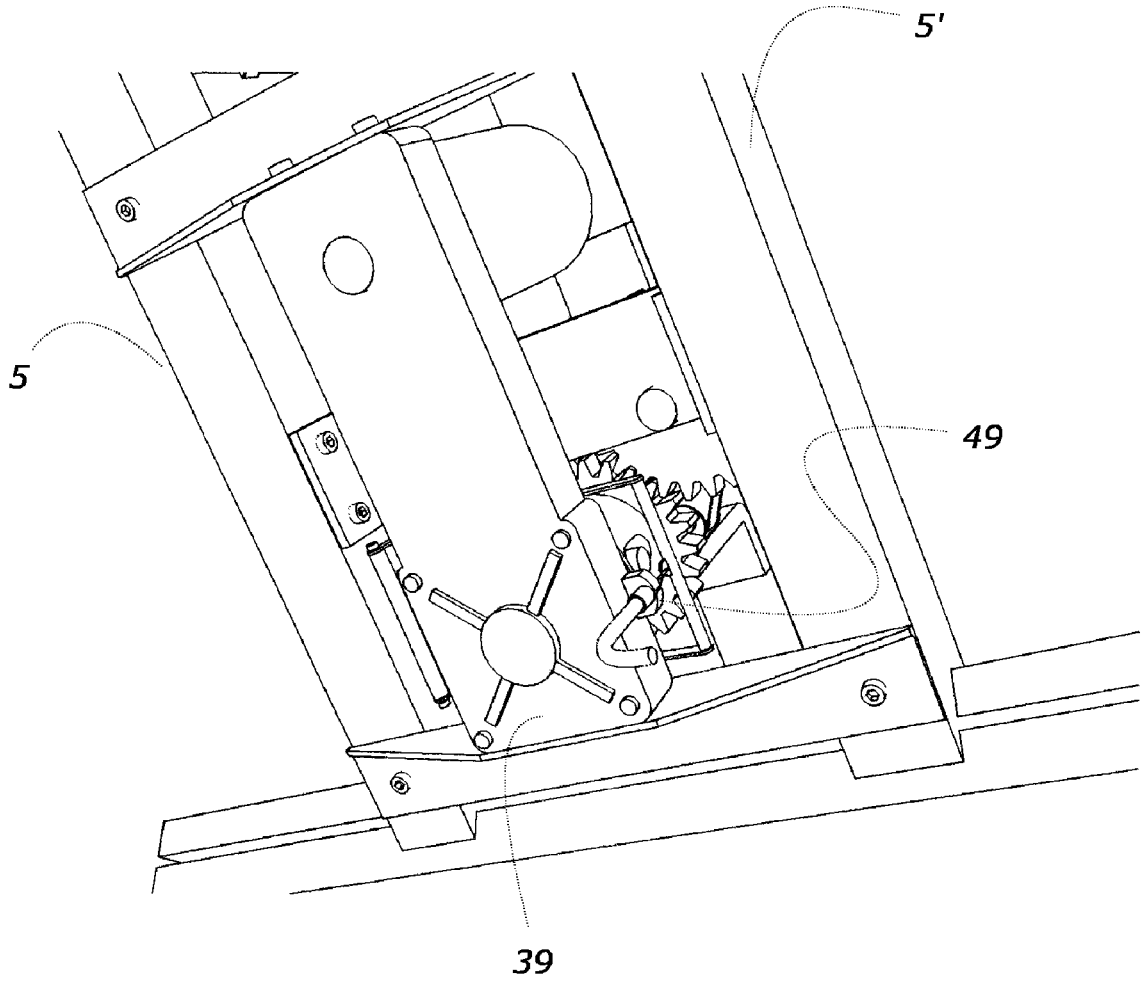
FIG. 17 is a view of the geared motor with system for releasing the pinion.

As illustrated in FIG. 14 it is implemented with a self-braking geared motor with reversal of the rotation direction (39) connected, by means of a chain, to a toothed wheel with large diameter (40) integral to a disk; onto the disk a pin transmits the motion to a linear guide (41) inserted into the arm of a rocker lever (42) moving alternatively between two extreme sites. At the ends of the rocker lever (42), as illustrated in FIG. 15, two pulleys with double-step pulleys (43-43') are pivoted, whereon a double row of pre-tensioned steel wires (44) slides. The wires are connected, on one side, to a fixed site (45) of the central beam of the bearing structure—which on the upper side also acts like eaves—and, on the other side, to the flights by means of the supports (46-46') with sensors of minimum and maximum load, the function thereof has been already treated previously. In FIG. 16 it is illustrated how onto the toothed wheel there are magnets (47-47') which, in a suitable arrangement, determine, when they are at the magnetic switches (48-48'), the locking sites, the reversal of the rotation direction and the stand-by position. All safety systems and control circuits supervising the escalator functionality, apart from the traction deactivation (49) illustrated in FIG. 17, remain unaltered with respect to the previous embodiment. The motion transmission to the steps by means of steel cables, essential in the present solution but applicable also to the preceding one, increases the level of passive safety of the device, such as for example accidents by crushing, as the flights during the descending phase are subjected exclusively to the force of gravity, as it has no connection integral to the traction members.

During the implementation phase both particular and constructive embodiments different from the present invention could be used without departing from the scope of the invention.

The invention claimed is:

1. Escalator comprising:

a) an escalator bearing structure;

b) a first and a second flight, said flights being side by side and parallel to each other, each flight comprising uprights and related steps, each flight being constituted by a same number of equidistant steps, the flights being adapted to slide with respect to the escalator bearing structure and the steps being pivoted in an inner portion of the uprights for rotating freely upwards in case of accidental interposition of foreign bodies;

c) motion means, so that said flights have a synchronized reciprocating motion of the pace corresponding to a step, wherein such means can be operated by the user of the same escalator; and d) safety means for locking the motion of the escalator responsive to the rotation of said steps.

2. Escalator according to claim 1, wherein the flights are equipped with sensors for the applied loads, said safety means comprising a circuit for locking the motion if excessive load is applied onto the flights.

3. Escalator according to claim 1, wherein said safety means for locking the motion comprise safety motion switches placed at contact points between said steps and said uprights.

4. Escalator according to claim 1, wherein said safety means comprise two safety sensitive platforms, a lower one and an upper one, said platforms being equipped with sensors adapted to lock the already operating escalator if said platforms are subjected to the trampling of another user.

5. Escalator according to claim 1, further comprising a handrail equipped with manual activation control.

6. Escalator according to claim 1, wherein the motion means is mainly constituted by an engine block equipped with two mirror worm self-braking geared motors with opposite axes transmitting, with suitable means, the reciprocating synchronized motion of the pace of a step to the flights.

7. Escalator according to claim 2, wherein said safety means for locking the motion comprise safety motion switches placed at contact points between said steps and said uprights.

8. Escalator according to claim 2, wherein said safety means comprise two safety sensitive platforms, a lower one and an upper one, said platforms being equipped with sensors adapted to lock the already operating escalator if said platforms are subjected to the trampling of another user.

9. Escalator according to claim 3, wherein said safety means comprise two safety sensitive platforms, a lower one and an upper one, said platforms being equipped with sensors adapted to lock the already operating escalator if said platforms are subjected to the trampling of another user.

10. Escalator according to claim 2, further comprising a handrail equipped with manual activation control.

11. Escalator according to claim 3, further comprising a handrail equipped with manual activation control.

12. Escalator according to claim 4, further comprising a handrail equipped with manual activation control.

13. Escalator according to claim 2, wherein the motion means is mainly constituted by an engine block equipped with two mirror worm self-braking geared motors with opposite axes transmitting, with suitable means, the reciprocating synchronized motion of the pace of a step to the flights.

14. Escalator according to claim 3, wherein the motion means is mainly constituted by an engine block equipped with two mirror worm self-braking geared motors with opposite axes transmitting, with suitable means, the reciprocating synchronized motion of the pace of a step to the flights.

15. Escalator according to claim 4, wherein the motion means is mainly constituted by an engine block equipped with two mirror worm self-braking geared motors with opposite axes transmitting, with suitable means, the reciprocating synchronized motion of the pace of a step to the flights.

16. Escalator according to claim 5, wherein the motion means is mainly constituted by an engine block equipped with two mirror worm self-braking geared motors with opposite axes transmitting, with suitable means, the reciprocating synchronized motion of the pace of a step to the flights.

* * * * *